US011865420B2

(12) United States Patent
Miller

(10) Patent No.: US 11,865,420 B2
(45) Date of Patent: Jan. 9, 2024

(54) TOWEL CLAMP AND MOISTURIZER FOR GOLF

(71) Applicant: Matthew L. Miller, Rome, NY (US)

(72) Inventor: Matthew L. Miller, Rome, NY (US)

( * ) Notice: Subject to any disclaimer, the term of this patent is extended or adjusted under 35 U.S.C. 154(b) by 153 days.

(21) Appl. No.: 17/708,112

(22) Filed: Mar. 30, 2022

(65) Prior Publication Data

US 2023/0310957 A1 Oct. 5, 2023

(51) Int. Cl.

| | |
|---|---|
| ***A63B 57/60*** | (2015.01) |
| ***A63B 47/04*** | (2006.01) |
| ***A63B 55/00*** | (2015.01) |
| ***A47K 10/12*** | (2006.01) |

(52) U.S. Cl.

CPC ..... *A63B 57/60* (2015.10); *A47K 10/12* (2013.01); *A63B 47/04* (2013.01); *A63B 55/408* (2015.10)

(58) Field of Classification Search

CPC ..... A63B 57/60; A63B 55/408; A63B 47/04; A47K 10/12

See application file for complete search history.

(56) References Cited

U.S. PATENT DOCUMENTS

| | | | | |
|---|---|---|---|---|
| 3,779,236 | A * | 12/1973 | Stewart | A61B 5/0235 D24/165 |
| 4,350,457 | A | 9/1982 | Carnahan | |
| 4,464,072 | A | 8/1984 | Norwell | |
| 4,901,406 | A * | 2/1990 | Shelby | A63B 55/408 24/3.13 |
| 5,318,292 | A | 6/1994 | De Marco | |
| 5,590,773 | A * | 1/1997 | Robinett | A63B 57/60 206/315.3 |
| 6,216,305 | B1 | 4/2001 | Joh | |
| 6,282,741 | B1 * | 9/2001 | Manning | A63B 47/04 15/210.1 |
| 8,171,593 | B2 | 5/2012 | Sprague | |
| 8,286,296 | B1 | 10/2012 | Nakamura et al. | |
| 9,802,092 | B2 | 10/2017 | Repasky, Jr. | |
| 10,251,471 | B1 * | 4/2019 | Sanderson | A46B 11/0017 |
| 10,828,544 | B1 * | 11/2020 | Sharp | A63B 47/04 |

(Continued)

FOREIGN PATENT DOCUMENTS

| | | | | |
|---|---|---|---|---|
| GB | 2402963 A | * | 12/2004 | A45F 5/00 |

OTHER PUBLICATIONS

Caddy splash golf water brush with reservoir tube and squeeze bottle sold on amazon.com, first available date: Apr. 15, 2021, https://www.amazon.com/Caddy-Splash-Water-Cleaner-Retractor/dp/B08X272XWT (Year: 2021).*

*Primary Examiner* — Terrell L McKinnon
*Assistant Examiner* — Ding Y Tan
(74) *Attorney, Agent, or Firm* — Bernhard P Molldrem, Jr.

(57) ABSTRACT

A combination golf towel holder both clamps the towel and provides for moistening the towel while it is clamped. The device has a front portion that includes an upper part that includes a reservoir and a lower clamp portion. A generally planar back plate that is attached to the upper part of the front portion, and has a lower jaw part that acts with the lower clamp portion to hold the towel. Water or another aqueous liquid is injected via an orifice in the back of the front portion when a squeeze bulb is depressed. The unit can be hung from a golf bag or golf cart so the towel is ready for use during play on the golf course.

11 Claims, 8 Drawing Sheets

(56) References Cited

U.S. PATENT DOCUMENTS

| | | | | |
|---|---|---|---|---|
| 2005/0230426 | A1* | 10/2005 | de la Guardia | B05B 9/0822 222/207 |
| 2006/0037163 | A1* | 2/2006 | Steinway | A63B 57/60 15/118 |
| 2009/0193598 | A1* | 8/2009 | Sprague | A63B 57/60 15/210.1 |
| 2010/0077560 | A1* | 4/2010 | Cabullo | A63B 47/04 15/209.1 |
| 2012/0110799 | A1* | 5/2012 | Pellei | A47F 7/143 24/570 |
| 2015/0327746 | A1* | 11/2015 | Winston | A61Q 19/10 15/227 |
| 2020/0383529 | A1* | 12/2020 | Forutanpour | A47K 10/02 |

* cited by examiner

TOWEL CLAMP AND MOISTURIZER FOR GOLF

BACKGROUND OF THE INVENTION

This invention relates to an attachment to a golf club carrier, e.g., golf bag or golf cart, for holding a golf towel and allowing the user to wet or moisten the towel when it is clamped in the attachment. The invention more specifically concerns a device that can attach to the user's golf bag or cart, and clamps onto a golf towel to hold it until it is needed for cleaning off a golf club, golf ball, or other golf equipment. The invention also concerns devices that combine the features of a clamping mechanism for holding the golf towel, and a mechanism for dispensing water (or an aqueous solution containing detergent or another cleaning agency) from a reservoir. In particular, the invention incorporates the reservoir and dispensing mechanism into the towel clamping mechanism, to provide a simple-to-use mechanism to dispense aqueous fluid onto the towel. The invention also concerns such devices which can be easily and conveniently suspended from or otherwise attached onto the golfer's golf bag or other golf equipment, and which releasably clamps onto the golf towel so that the towel is available for cleaning and wiping a club face or other golf equipment.

Golf equipment washers and club cleaners have been proposed, which incorporate a cleaner and a container for water, so that the water is available for dispensing onto a golf towel. (U.S. Pat. No. 4,330,497). A device in the form of an attachment for a golf bag, which incorporates a clamp for holding a golf towel, a scrubber, and a container for holding and dispensing water or cleaning solution has been proposed. (U.S. Pat. No. 464,072) Other cleaning apparatus for golf clubs and other equipment has been proposed in which a special golf towel integrated with a porous mesh and with a mechanism for wetting the golf towel has also been proposed (U.S. Pat. No. 8,171,593). No one has yet proposed or provided a golf towel clamp and moisturizer in the form of a front body that includes a reservoir for water or aqueous cleaning solution, a clamp for holding the towel, and a mechanism for dispensing the aqueous solution onto the towel while held in the clamp.

OBJECTS AND SUMMARY OF THE INVENTION

Accordingly, it is an object to provide a tool that can be mounted on a golf cart, golf bag, or the like, and which incorporates a clamp for releasably holding the golf towel and a squeeze bulb or other simple actuator mechanism for dispensing water (or cleaning solution) from a reservoir incorporated into the clamp.

A more specific object of this invention is to provide a towel holder attachment with a front portion that includes the reservoir, a dispenser mechanism for pushing the aqueous solution out an aperture in a rear side of the front portion, and a back plate that is attached to the front portion that is sufficiently flexible so that bottom jaws on the front portion and the back plate can be spread apart to insert the towel.

Another object is to provide the towel holder and moisturizer attachment so it can be easily filled via an inlet tube or opening that leads to the reservoir in the upper part of the front portion.

According to an aspect of the present invention, a combination golf towel clamp and golf towel moistener is generally formed of a front member and a back plate. The front member includes an upper, somewhat globe-shaped member (or somewhat hemispherical) that is substantially rigid and hollow. This constitutes a reservoir for water with or without a detergent, or for another aqueous fluid. A squeeze bulb member on the hollow globe-shaped upper portion can be depressed for urging the fluid out of the reservoir through a rear opening to moisten the golf towel, i.e. an orifice on a rear side of the front member. A valve mechanism in the hollow upper portion is actuated by the squeeze bulb member for ejecting the fluid from the reservoir through the rear orifice. Below the globe-shaped member, a front jaw member extends downward;

A back plate is generally co-extensive with the back surface of the front member, and has an upper portion affixed onto a back side of the upper portion of the front member, e.g. with threaded fasteners. A rear jaw portion extends down from the upper portion of the rear plate and there is a reduced-thickness flex area between the upper portion and the lower jaw portion. This flex area yieldably urges the rear jaw portion of the back plate against the front jaw member of the front member. These components are configured so as to hold a golf towel between them, but also permit the user to remove the towel when he needs to use it. The front member is configured such that depressing the squeeze bulb member results in a quantity of aqueous liquid being dispensed from the reservoir onto the golf towel when the latter is retained between the front jaw member and the rear, lower jaw portion.

Favorably, the upper portion of said front member (i.e., the reservoir) is formed of a rigid or semi-rigid plastic resin with a generally hemispherical shape. Also, in a favored embodiment, the front jaw member is tapered to a duck-bill shape. The rear opening in the rear side of the front member can take the form of a horizontal groove having one or more penetrations into the reservoir, with the grooved shape aiding in spreading the water over a wide area of the towel.

The flex area of said back plate has a first (reduced) thickness, and the upper portion and rear jaw portions of said back plate each have a thickness greater than the first thickness. This thickness can favorably be a full thickness of the back plate. The rounded or globular upper portion of the front member favorably has a concave and generally spherical, hollow socket region hollow formed where the squeeze bulb member is positioned.

Favorably, a stud member for fitting into a grommet on the golf towel is positioned on one or the other (or both) of the rear jaw portion of the back plate and the front jaw portion of the front member.

A retaining loop or similar member may be formed on the top of the back plate for attaching to a golf club carrier.

In favorable embodiments, the fill port for the reservoir is disposed at a top of the upper front portion of the towel holder and moistener.

Because of the incorporation of both the reservoir and the towel clamp into one unit, the unit can be designed to resemble a golf ball supported on a tee. That is, the upper portion of the front member may be shaped generally as a hemisphere to resemble a golf ball and the lower part of the front member can be configured to resemble a golf tee, which helps identify the device for its purpose. The outer surface of the generally spherical or hemispherical reservoir can have concave recesses to resemble dimples.

Favorably, the front member and the back plate are removably bolted together with screw fasteners through apertures in the back plate into threaded blind holes in a flat back wall of the front member.

These and other objects, features, and advantages of the invention will become apparent from the following detailed description of a selected preferred embodiment, which is to be read in connection with the accompanying Drawing:

DETAILED DESCRIPTION OF THE PREFERRED EMBODIMENT

Figure 1:
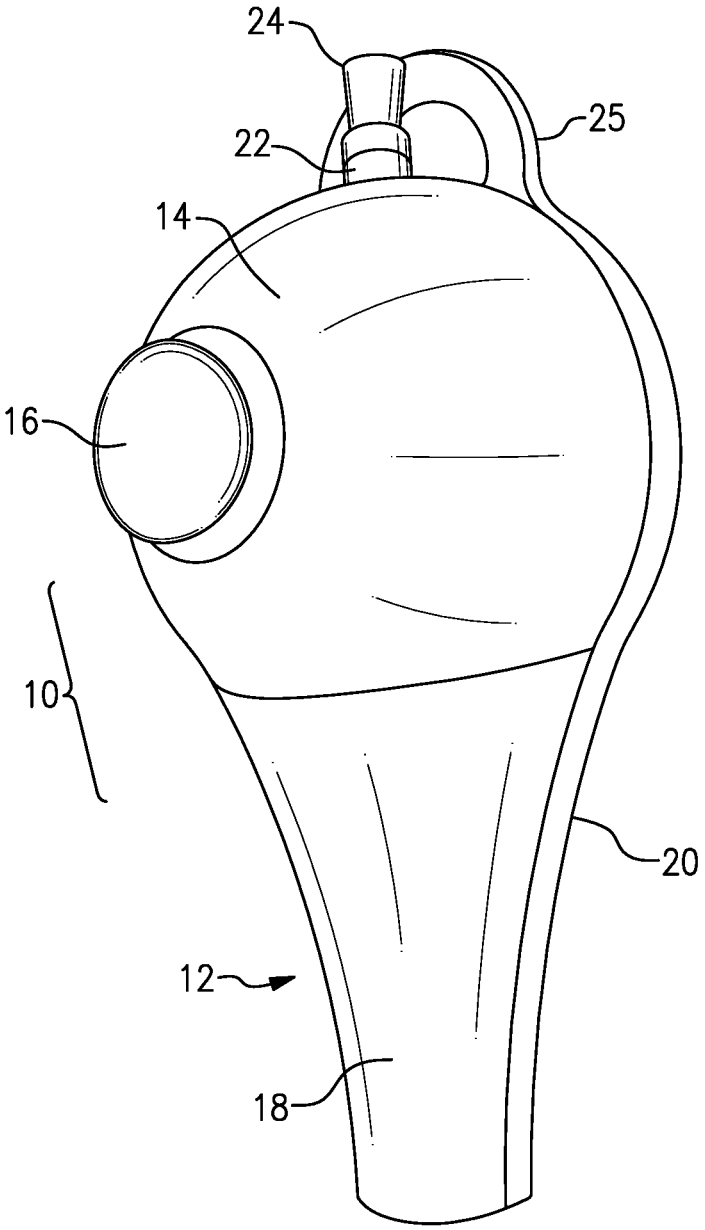
FIG. 1 is a perspective view from side and front of one embodiment of the invention.
Figure 2:
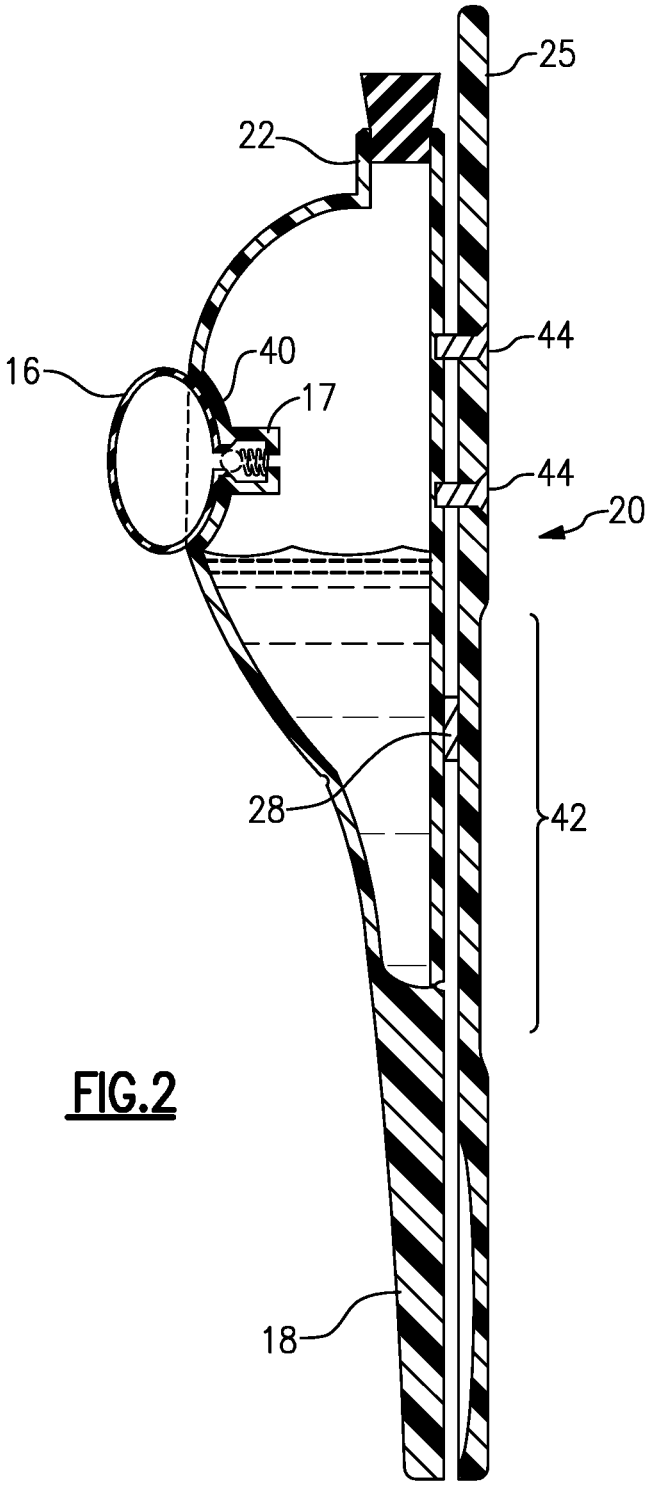
FIG. 2 is a sagittal sectional view of the FIG. 1 embodiment of this invention.
Figure 3:
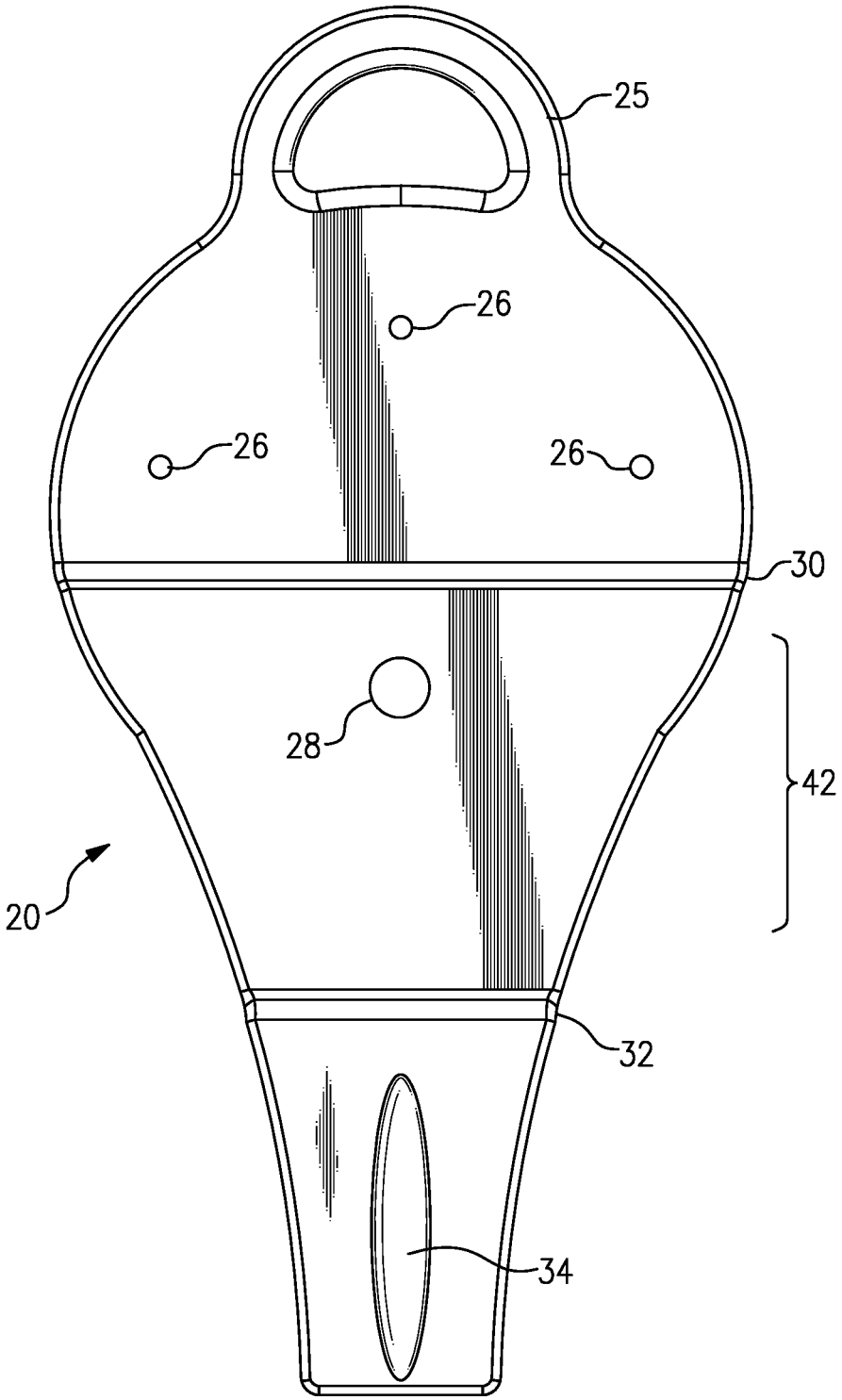
FIG. 3 is a elevation elevation of the back plate of the golf towel clamp and moistener of this embodiment.
Figure 4:
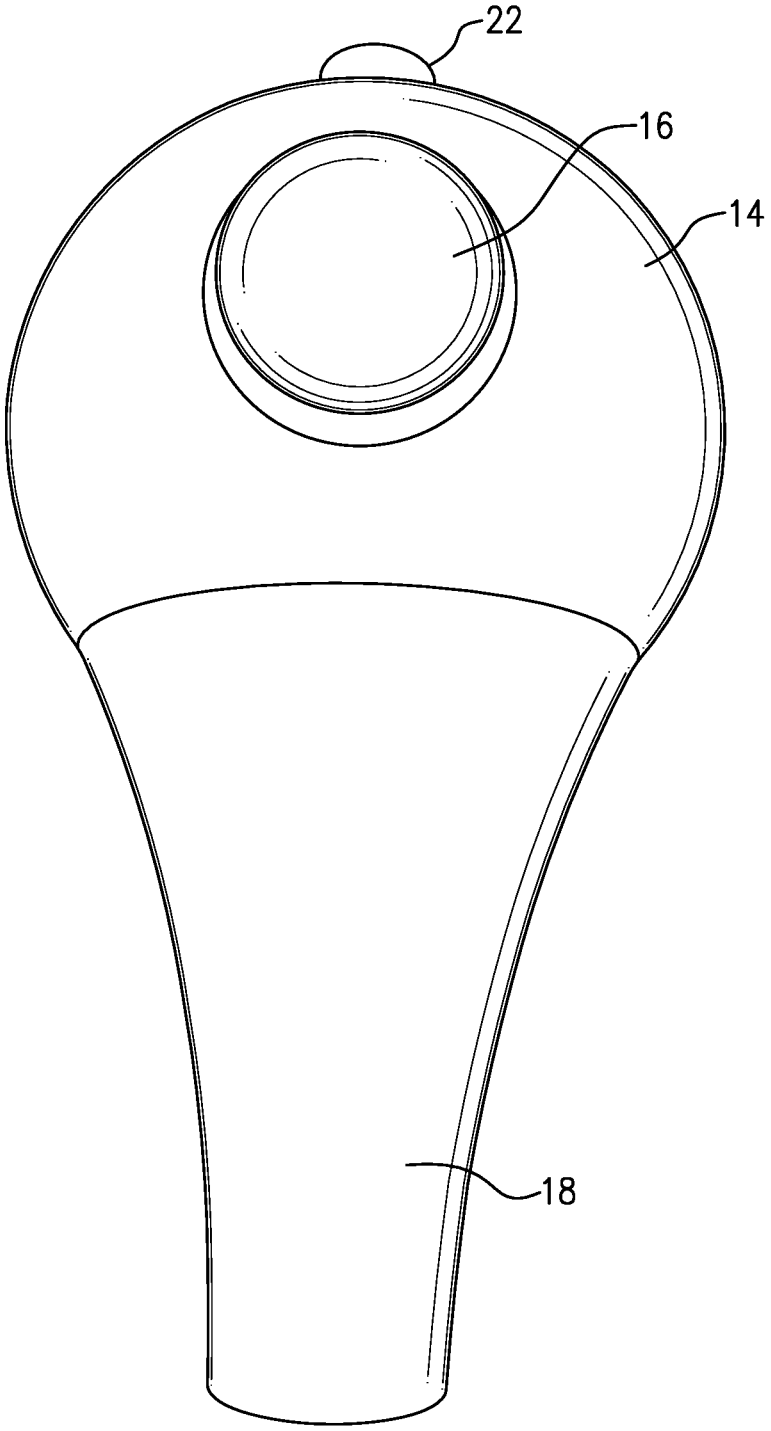
FIG. 4 is a front elevation of the front portion of the golf towel clamp and moistener.

With reference to the Drawing Figures, FIG. 1 depicts an embodiment of the combination golf towel clamp and towel moistener. A front portion 12 includes an upper portion in the form of a domed reservoir 14, which is basically spheroid or hemispheric in shape. This portion 12 is formed of a durable rigid or semi-rigid plastic. The domed reservoir 14 is hollow, and has a squeeze bulb actuator 16 mounted on the front. A lower portion 18 has generally a duck-bill shape. A back plate 20 is generally congruent with the rear profile of the front portion 12. Also shown here are a tubular fill port 22 at the top of the domed reservoir, with one example of a closure being a stopper or seal 24. An attachment loop 25 (shown also in FIG. 6) extends up from the upper end of the back plate and provides a convenient means for hanging the unit on a golf cart or golf bag. FIG. 3 shows a number of bores 26 for passage of screw fasteners to attach the back plate 20 to the front portion 12. Such screw fasteners can be received into corresponding threaded blind bores in the rear wall of the front portion. Returning to FIGS. 2 and 3, a stud or post 26 is affixed on a front facing side of the back plate 20 and can serve to fit into a grommet on the golf towel to secure it. The post 26 could in some embodiments be extending from the rear wall of the front portion towards the back plate.

Figure 5:
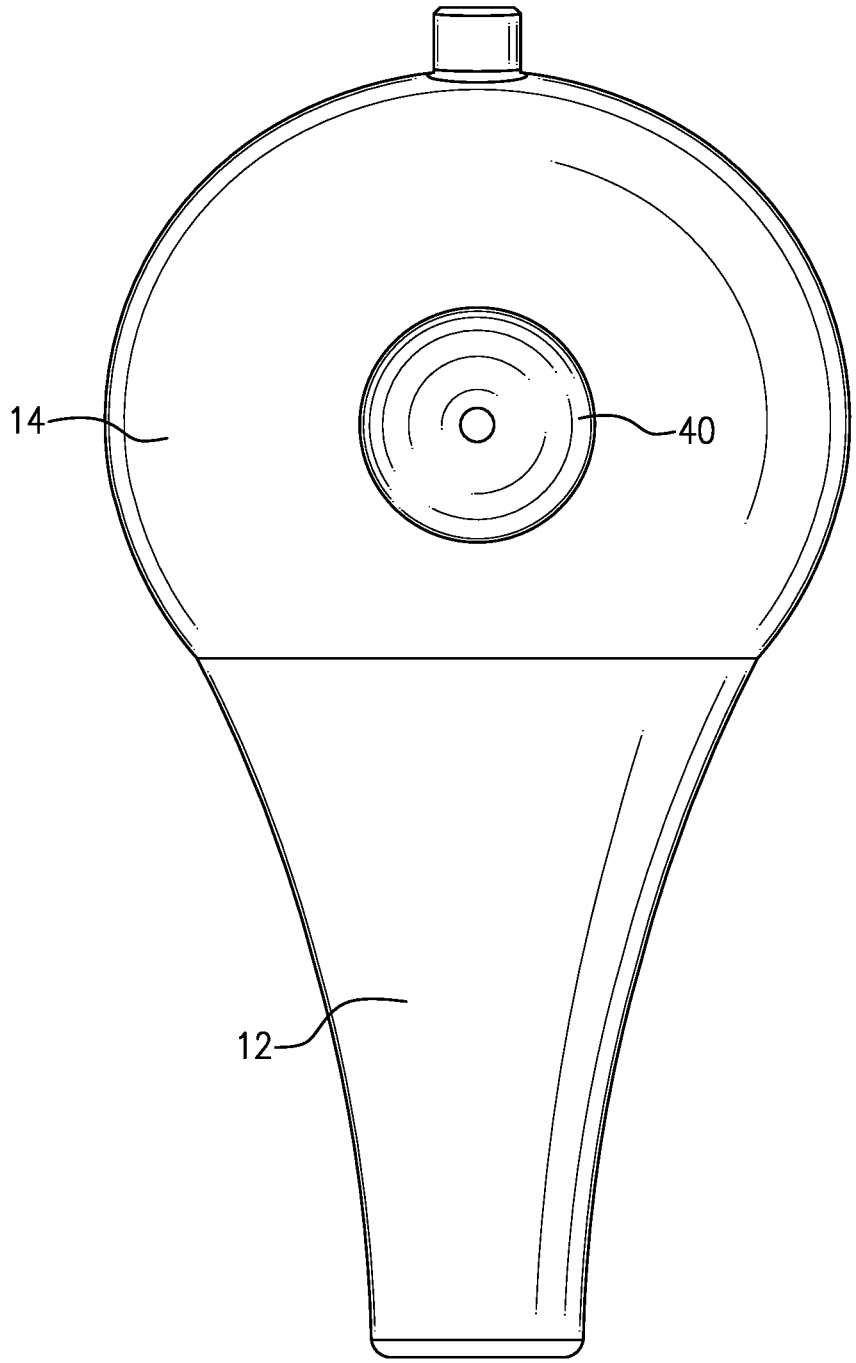
FIG. 5 is a perspective with the squeeze bulb omitted.

Upper and lower horizontal flex lines 30 and 32 mark edges of a reduced-thickness flex portion to be discussed shortly. In the lower end portion of the back plate, a vertical-axis oval-curved cut-out 34 helps spread the water or other liquid ejected onto the towel when clamped in place. Now turning to FIG. 5, a concave, generally spherical recess 40 in the domed reservoir portion of the front portion 12, and serves as a locus for placement of the squeeze bulb. As shown in FIG. 2, a linear check valve 17 is positioned inside the reservoir, and is coupled to the squeeze bulb 16. This serves as one example of a mechanism for squeezing the liquid out of the reservoir when the squeeze valve. 16 is pressed.

Figure 6:
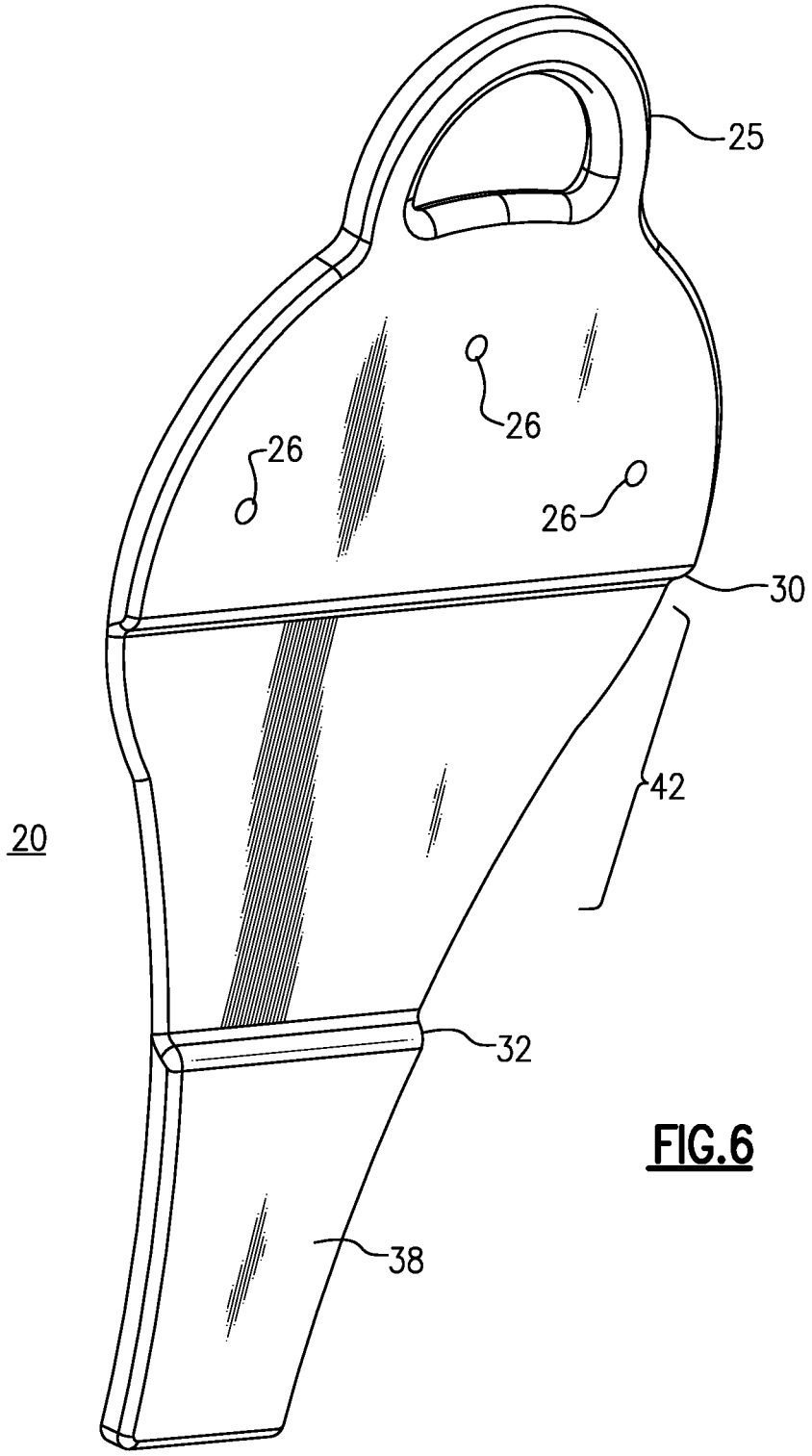
FIG. 6 is a front view of the back plate of this embodiment.
Figure 7:
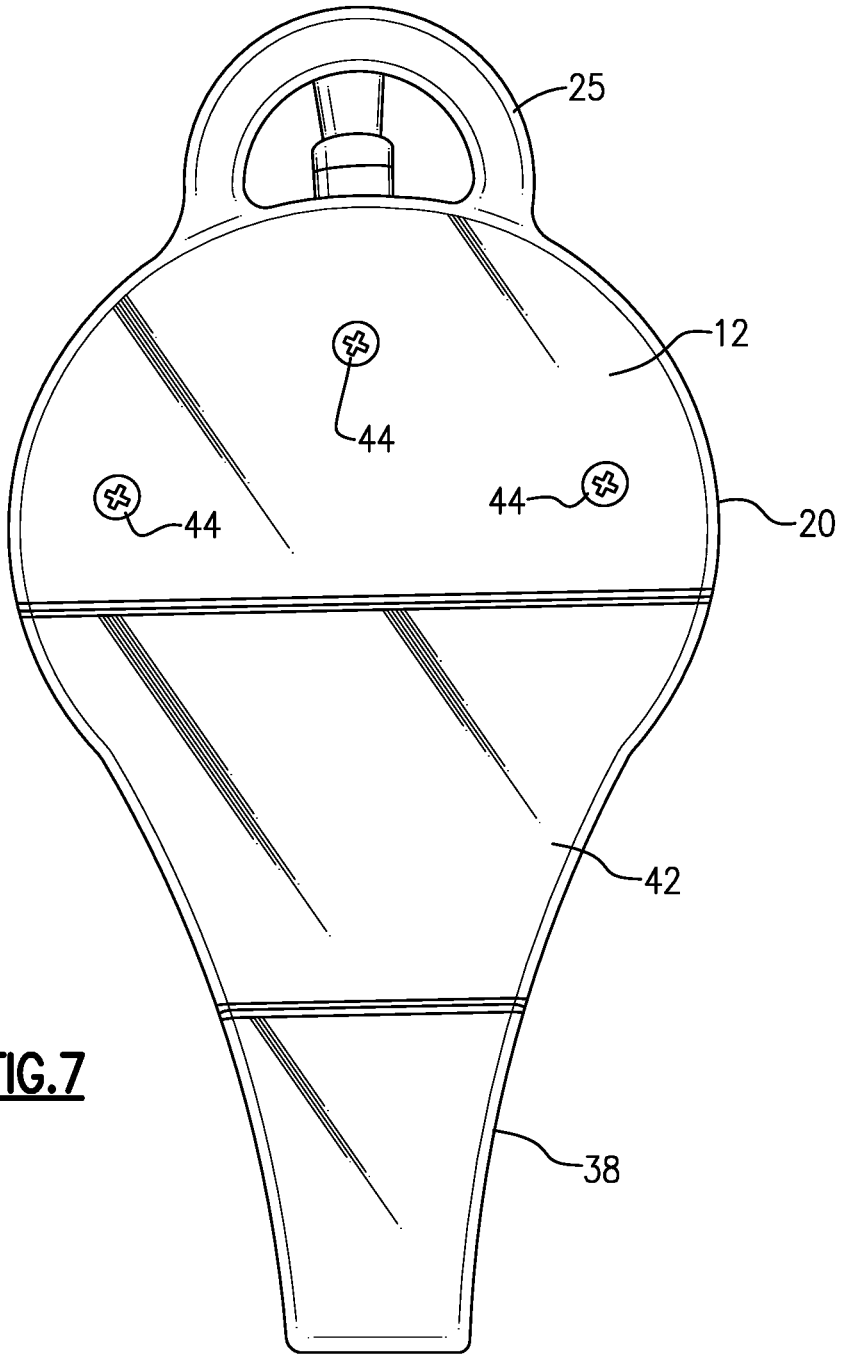
FIG. 7 is an elevation of the rear side of the back plate.

FIG. 6 shows the rear or outer side of the back plate 20. The flex portion 42 of the back plate is illustrated as a reduced-thickness portion between the upper and lower flex lines 30 and 32. The upper portion (above flex line 30) is more rigid, as is the lower end 38, below the lower flex line 32. This lower end 38 serves as a rear jaw portion for retaining the golf towel, in cooperation with the lower duck-bill shaped end 18 of the front portion 12, so that the two portions together serve as clamping jaws for the golf towel. As seen in FIG. 7, the upper portion of the of the back plate 20 can be affixed to the upper part of the front portion by means of threaded screws 44 (See also FIG. 2). This arrangement with the screws 44 is one of many possible ways of attaching the front portion with the back plate.

Figure 8:
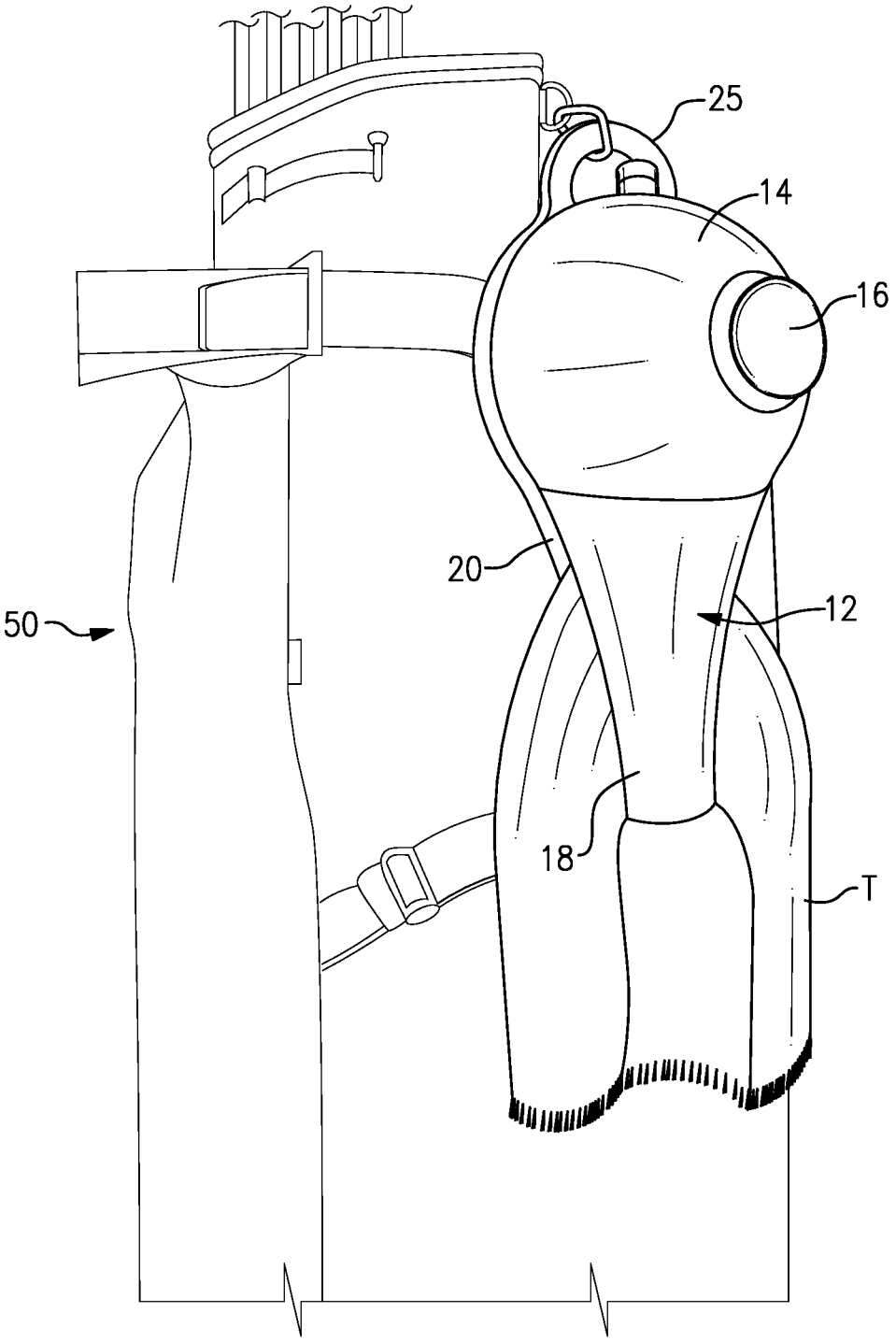
FIG. 8 is an environmental view showing the golf towel clamp and towel moistener according to an embodiment of the invention.

Finally, FIG. 8 illustrates the towel clamp and moisturizing arrangement of the foregoing embodiment, with the attachment loop 25 secured to a clip on a golf bag 50. Here the unit is shown with a golf towel T secured between the lower section 18 of the front portion and the corresponding lower end of the back plate 20. The two jaw portions can be pulled apart by the user for removing the towel T when needed to clean the golf equipment. When the cleaning is finished, the towel T can be easily replaced there.

While the present invention has been described with reference to specific preferred embodiment(s), it should be understood that the invention is not limited to such precise embodiment(s). Rather, many modifications and variations would present themselves to persons skilled in the art without departure from the scope and spirit of this invention, as defined in the appended claims.

What is claimed is:

1. Combination golf towel clamp and golf towel moistener comprising:

a front member that includes an upper substantially rigid hollow upper portion configured to constitute a reservoir for an aqueous fluid; a squeeze bulb member on said hollow upper portion; a rear opening on a rear side of said front member; and a valve mechanism on said hollow upper portion, actuated by said squeeze bulb member for ejecting an amount of said aqueous fluid from said reservoir through said rear opening; and a front jaw member extending downward from said upper portion of the front member;

a back plate having an upper portion affixed onto a back side of the upper portion of said front member, and having a rear jaw portion extending down from said upper portion of said back plate; and at least a flex area between said upper portion and said rear jaw portion of the back plate, adapted for yieldably urging the rear jaw portion of the back plate against the front jaw member; and configured so as to removably hold a golf towel between the front jaw member and the rear jaw portion; and the front member being configured such that depressing said squeeze bulb member results in said aqueous liquid being dispensed from said reservoir onto said golf towel when the latter is retained between the front jaw member and the rear jaw portion.

2. The golf towel clamp and moistener according to claim 1, wherein said upper portion of said front member is formed of a rigid or semi-rigid plastic resin with a generally hemispherical shape.

3. The golf towel clamp and moistener according to claim 1, wherein said front jaw member is tapered to a duck-bill shape.

4. The golf towel clamp and moistener according to claim 1, wherein said rear opening in the rear side of said front member is in the form of a horizontal groove having one or more penetrations into said reservoir.

5. The golf towel clamp and moistener according to claim 1, wherein the flex area of said back plate has a first thickness, and the upper portion and rear jaw portions of said back plate each have a thickness greater than said first thickness.

6. The golf towel clamp and moistener according to claim 1, wherein said upper portion of said front member has a spherical hollow formed therein wherein said squeeze bulb member is positioned.

7. The golf towel clamp and moistener according to claim 1, wherein one or both of the rear jaw portion of the back plate and the front jaw portion of said front member includes a projecting stud member configured to retain a grommet of said golf towel.

8. The golf towel clamp and moistener according to claim 1, wherein said back plate includes a rigid loop formed at a top end of the back plate for attaching to a golf club carrier.

9. The golf towel clamp and moistener according to claim 1, wherein a fill port for said reservoir is disposed at a top of the upper part of reservoir.

10. The golf towel clamp and moistener according to claim 1, wherein said upper portion of said front member is shaped generally as a hemisphere to resemble a golf ball and the lower part of the front member configured to resemble a golf tee.

11. The golf towel clamp and moistener according to claim 1, wherein the front member and the back plate are removably bolted together with screw fasteners through apertures in the back plate into threaded blind holes in a flat back wall of the front member.

* * * * *